US008539925B2

(12) United States Patent
Gleason

(10) Patent No.: US 8,539,925 B2
(45) Date of Patent: Sep. 24, 2013

(54) STARTER FOR TWO-CYCLE ENGINES

(76) Inventor: Frank J. Gleason, Sidney, OH (US)

( * ) Notice: Subject to any disclaimer, the term of this patent is extended or adjusted under 35 U.S.C. 154(b) by 338 days.

(21) Appl. No.: 13/094,044

(22) Filed: Apr. 26, 2011

(65) Prior Publication Data

US 2011/0265753 A1 Nov. 3, 2011

Related U.S. Application Data

(60) Provisional application No. 61/330,286, filed on Apr. 30, 2010.

(51) Int. Cl.
*F02N 5/00* (2006.01)
*F02N 1/00* (2006.01)

(52) U.S. Cl.
USPC ..... 123/185.3; 123/185.2

(58) Field of Classification Search
USPC ..... 123/185.1, 185.2, 185.3, 185.4–185.6, 123/51 B; 74/6, 7 B, 139, 140
See application file for complete search history.

(56) References Cited

U.S. PATENT DOCUMENTS

| | | | | |
|---|---|---|---|---|
| 1,963,256 | A * | 6/1934 | Bickerstaff | 417/213 |
| 2,804,957 | A | 9/1957 | Pechin, Jr. | |
| 3,018,618 | A | 1/1962 | Williams et al. | |
| 3,297,010 | A | 1/1967 | Beck | |
| 3,331,363 | A | 7/1967 | Holton, Jr. | |
| 3,537,436 | A | 11/1970 | Heisler | |
| 3,616,785 | A * | 11/1971 | Smith et al. | 123/179.31 |
| 3,645,247 | A | 2/1972 | D'Ambrosio | |
| 4,085,589 | A | 4/1978 | Breisch | |
| 4,531,482 | A | 7/1985 | Scheckel | |
| 4,569,315 | A | 2/1986 | Bodnar | |
| 4,803,963 | A | 2/1989 | Kleinhans | |
| 5,070,828 | A * | 12/1991 | Chestnutt | 123/185.4 |
| 5,174,166 | A | 12/1992 | Tryon et al. | |
| 5,253,540 | A | 10/1993 | Sanders et al. | |
| 5,285,693 | A | 2/1994 | Sanders et al. | |
| 5,345,900 | A | 9/1994 | Wisegerber | |
| 5,664,527 | A | 9/1997 | Boudy | |
| 5,762,037 | A | 6/1998 | Rothrock | |
| 6,321,709 | B1 | 11/2001 | Lyon | |
| 6,497,210 | B1 * | 12/2002 | Kattenhorn | 123/185.4 |
| 6,722,336 | B2 | 4/2004 | Nieda et al. | |
| 6,758,181 | B2 | 7/2004 | Iida et al. | |
| 7,161,253 | B2 | 1/2007 | Sodemann et al. | |
| 7,322,334 | B1 * | 1/2008 | O'Brien | 123/185.4 |
| 7,331,321 | B2 | 2/2008 | Thompson | |
| 7,525,287 | B2 | 4/2009 | Miyashita et al. | |
| 7,530,340 | B1 | 5/2009 | Jellinek et al. | |
| 2002/0092493 | A1 | 7/2002 | Iida et al. | |
| 2004/0244754 | A1 | 12/2004 | Smith | |
| 2007/0000466 | A1 | 1/2007 | Thompson | |
| 2008/0127930 | A1 | 6/2008 | Thompson | |

* cited by examiner

*Primary Examiner* — Mahmoud Gimie
(74) *Attorney, Agent, or Firm* — Thomas E. Lees, LLC

(57) ABSTRACT

A two-cycle engine starting device comprises a support structure having a tool securement attached to a base, e.g., a tripod. The tool securement has a holding plate and at least one locking arrangement that temporarily holds a tool to the support structure. A cylinder is secured to the support structure, having a cylinder rod that extends and retracts in a linear motion. An actuation control operates the cylinder. As such, a two-cycle engine is started by positioning the tool on the tool securement so as to be temporarily held by at least one locking arrangement, slipping the starter rope handle into a handle holding mount at the distal end of the cylinder rod, and by operating the actuation control, thus causing the cylinder to extend the handle holding mount in a linear motion that pulls the starter rope with sufficient force to apply a starting force to start the tool.

20 Claims, 7 Drawing Sheets

STARTER FOR TWO-CYCLE ENGINES

CROSS REFERENCES TO RELATED APPLICATIONS

This application claims the benefit of U.S. Provisional Patent Application Ser. No. 61/330,286 filed Apr. 30, 2010, entitled "STARTER FOR TWO-CYCLE ENGINES" the disclosure of which is hereby incorporated by reference.

BACKGROUND

Various embodiments of the present invention relate in general, to devices that assist a user in starting a two-cycle engine, and more particularly, to devices that automatically pull the starter rope of two-cycle engine devices.

Small internal combustion engines are commonly used to provide powered motion of a work implement. For instance, small internal combustion engines have been used to power a cutting mechanism or an auger, on tools and other equipment including chain saws, lawn mowers, tillers, edgers, string trimmers, snow blowers, powered post hole diggers, etc.

The vast majority of engines provided on such tools are adapted with a rope-pulled recoil starter. The rope-pulled recoil starter includes a rope that is wound upon a spool, which is biased by a recoil spring. To start the engine, a user of the tool performs a start operation by pulling a handle attached to the outer end of the rope. As the handle is pulled, the rope unwinds from the spool causing the spool to rotate. As the spool rotates, a clutch enables engagement of the spool with an input shaft of the engine so as to rotate the input shaft. If the input shaft is turned with an appropriate stroke, the engine cycles and starts running Upon release of the rope, the recoil mechanism retracts the rope back onto the spool. More particularly, the clutch is released from the input shaft as the spool rotates back in response to the recoil mechanism, thus allowing the engine to idle as the rope is rewound back onto the spool. If the engine failed to cycle and begin running in response to pulling the rope, the user can re-attempt the start operation by pulling the rope again. The above process may be repeated until the engine starts.

BRIEF SUMMARY

According to various aspects of the present invention, a two-cycle engine starting device comprises a support structure having a tool securement. The tool securement includes a holding plate and at least one locking arrangement that temporarily holds or otherwise secures a two-cycle engine equipped tool to the holding plate during starting operations. The starting device also comprises a cylinder secured to the support structure. The cylinder includes a cylinder housing and a cylinder rod controllable to extend from the cylinder housing in a linear motion. The starting device also includes a handle holding mount coupled to an end of the cylinder rod that holds a handle attached to a starter rope of the two-cycle engine when the two-cycle engine is positioned on the holding plate, and an actuation control having a control element that is operable to cause the cylinder rod to extend from the cylinder housing.

According to further aspects of the present invention, a two-cycle engine starting device comprises a support structure having a holding plate, a first locking arrangement, a second locking arrangement and a third locking arrangement. The holding plate is configured to hold a chainsaw. The first locking arrangement is arranged such that, when a chainsaw is installed on the holding plate, the first locking arrangement temporarily holds the chainsaw to the holding plate by preventing a handle of the chainsaw from lifting up. The second locking arrangement includes a cantilevered arm comprising a first block section attached to the holding plate and a second block section that extends from the top of the first block section generally out over the holding plate such that when a chainsaw is installed on the holding plate, the second block section serves as a hold down to prevent up lifting of the chainsaw during starter rope pulls. The third locking arrangement defines a throttle guard lock attached to the holding plate. The third locking arrangement is configured such that, when a chainsaw is installed on the holding plate, the third locking arrangement temporarily retains a handle of a chainsaw on the holding plate from lifting during starting operations.

The two-cycle engine starting device further comprises a cylinder, a handle holding mount and an actuation control. The cylinder is secured to the support structure, and includes a cylinder housing and a cylinder rod controllable to extend from the cylinder housing in a linear motion. The handle holding mount is coupled to an end of the cylinder rod and the actuation control has a control element that is operable to cause the cylinder rod to extend from the cylinder housing.

In this regard, a two-cycle engine is started by positioning a corresponding tool on the holding plate so as to be temporarily held at least by the first, second and third locking arrangements, slipping the starter rope handle into the handle holding mount, and operating the actuation control, thus causing the cylinder to extend the cylinder rod and corresponding handle holding mount in a linear motion that pulls the starter rope with sufficient force to apply a starting force to the two-cycle engine.

According to still further aspects of the present invention, a method for starting a two-cycle engine including a starter rope with a handle, is provided. The method comprises positioning a tool with the two-cycle engine to be started on a holding plate so as to be temporarily held by at least one locking arrangement on the holding plate, slipping the handle of the starter rope into a handle holding mount coupled to a cylinder rod, and operating an actuation control coupled to a pressurized air source, which causes pressurized air to extend the cylinder rod and to move the handle holding mount in a linear motion that pulls the starter rope with sufficient force to apply a starting force to the two-cycle engine.

For simplicity and clarity of illustration, elements shown in the figures have not necessarily been drawn to scale. For example, the dimensions of some of the elements may be exaggerated relative to other elements for clarity of discussion.

DETAILED DESCRIPTION

Figure 1:
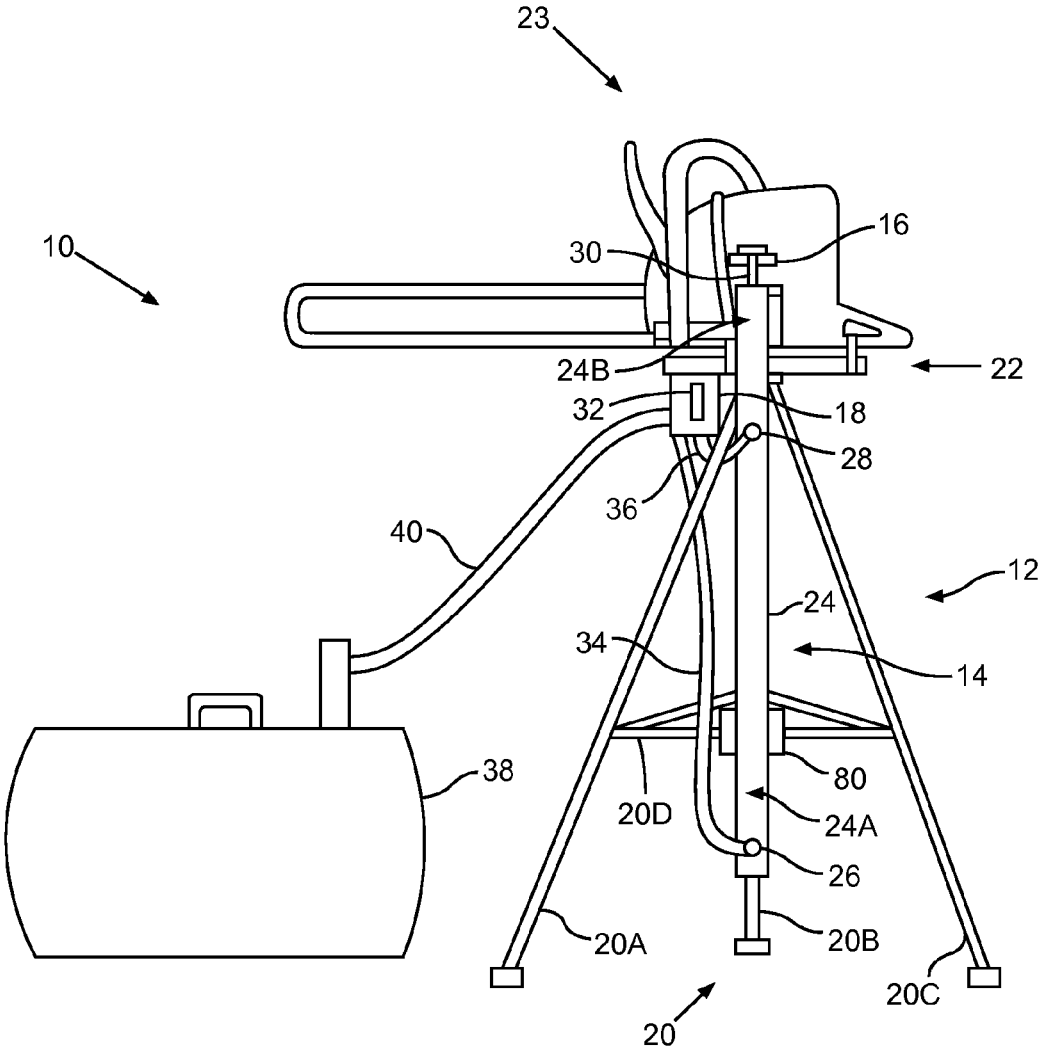
FIG. 1 is a view of the two-cycle engine starting device, illustrating a cylinder having a cylinder rod in a default position, according to various aspects of the present invention.

Referring now to the drawings, and in particular, to FIG. 1, a two-cycle engine starting device 10 is illustrated according to various aspects of the present invention. In general, the two-cycle engine starting device 10 comprises a support structure 12, a cylinder 14, a handle holding mount 16 and an actuation control 18.

The support structure 12 in the illustrative implementation comprises a base 20 and a tool securement 22. The base 20 may be implemented, for example, as a tripod stand. By way of illustration, the tripod stand can include three legs 20A, 20B, 20C. The legs are optionally adjustable and/or telescoping, e.g., to provide for height adjustment and/or leveling of the tool securement 22 in a variety of environments. The tripod stand may also optionally include any other desired features, such as a bracing structure 20D, e.g., located generally towards a lower portion of the tripod that supplies support to the legs 20A, 20B and 20C. However, in practice, the support structure 12 can be implemented by other structural configurations, depending for example, upon the particular tool or types of tools that the two-cycle engine starting device 10 is configured to start. For instance, the support structure 12 may be implemented with different features, different structures, optional add-on accessories, configurations etc., for applications utilized to start a chainsaw compared to a weed eater, an outboard motor, various engine-powered lawn and garden equipment, etc.

The tool securement 22 is attached to the base 20 and is provided to secure and hold a tool 23 in a "ready" position during the implementation of a starting operation. In the illustrative implementation, the tool securement 22 is suitable for supporting a tool such as a chainsaw. In this regard, the tool securement 22 comprises a generally horizontal holding plate secured towards the top of the base 20. This arrangement locates the holding plate of the tool securement 22 at an appropriate height to insert the chainsaw and remove the chainsaw from the two-cycle engine starting device 10 without bending over or requiring awkward limb movements. Moreover, as will be described in greater detail herein, the tool securement 22 has at least one locking arrangement that temporarily holds a two-cycle engine equipped tool, e.g., a chainsaw in the illustrative example, to the holding plate while the two-cycle engine is being started.

The cylinder 14, such as a linear actuator, pneumatic cylinder, etc., is rigidly secured to the support structure 12 so as to position the cylinder 14 in a predetermined orientation suitable for implementing a starting operation. For instance, the cylinder 14 is substantially vertical or perpendicular to a major surface of the holding plate, in the illustrated example. However, other orientations may alternatively be implemented, e.g., depending upon the specific starting requirements of the engine to be started and/or based upon the specific implementation, setting, configuration, adjustment, etc., of the structures of the starting device 10.

The cylinder 14 includes a cylinder housing 24 having a first end 24A and a second end 24B. A first supply port 26 is positioned generally towards the first end 24A of the cylinder housing 24, and a second supply port 28 is positioned generally towards the second end 24B of the cylinder housing 24. The cylinder housing 24 contains a piston (not shown) and a cylinder rod 30 that is supported by the piston. The cylinder rod 30 is controllable to extend from the second end 24B of the cylinder housing 24 in a linear motion. Correspondingly, the cylinder rod 30 can retract into the cylinder housing 24 through the second end 24B, as will be described in greater detail herein.

The handle holding mount 16 is coupled to an end the cylinder rod for linear motion therewith. For instance, as illustrated, the handle holding mount 16 is secured at a distal end of the cylinder rod 30 external to the cylinder housing 24. In this regard, the handle holding mount 16 traverses linearly in cooperation with movement of the cylinder rod 30. Moreover, when a tool (or engine) having a pull rope starting system is suitably positioned on the tool securement 22 of the support structure 12, a handle attached to the pull rope starting system of the engine slips into the handle holding mount 16 on the cylinder rod 30 to define the "ready" position for automated engine starting, as will be described in greater detail herein.

The actuation control 18 includes a control element 32 that is operable to initiate a starting operation by causing the cylinder rod 30 to extend from the cylinder housing 24. For instance, in the illustrative implementation, the actuation control 18 is connected to the first supply port 26 of the cylinder 14 using a first supply line 34. The actuation control 18 may also be connected to the second supply port 28 of the cylinder 14 using a second supply line 36. The actuation control 18 is further connected to a power source 38, e.g., an air tank, an air compressor or other suitable source of power, using a third supply line 40.

In an exemplary implementation, the actuation control 18 is implemented as a spring loaded pneumatic switch. Under this arrangement, the control element 32 may be implemented by a lever. By moving the lever in a first direction, the switch changes states from a default "Off" state to an "On" state, thus enabling the power source 38 to supply the necessary power to the cylinder 14 to extend the cylinder rod 30 in a linear direction out of the cylinder housing 24. When the user releases the lever of the actuation control 18, a spring bias returns the lever to a default position, thus transitioning the switch back to the default "Off" state. In response to the lever returning to the default position, the cylinder rod 30 retracts back or is otherwise retractable back into the cylinder housing 24.

Extension of the cylinder rod 30 linearly out of the cylinder housing 24 is referred to herein as an "out-stroke." The length that the cylinder rod 30 extends is referred to herein as the "cylinder stroke." Retraction of the cylinder rod 30 linearly back into the cylinder housing 24 is correspondingly referred to herein as an "in-stroke." In this regard, the length of the cylinder stroke, the positioning of the cylinder 14, the orientation of the cylinder 14, or a combination thereof can be taken into account to correspond with the length of starter rope that must be pulled to start a particular engine. Alternatively, the position and/or orientation of the cylinder 14 may be adjustable relative to a corresponding engine on the holding plate so that the cylinder stroke corresponds with the length of starter rope that must be pulled to start a particular engine.

In an illustrative example, the cylinder 14 is implemented as a double-acting cylinder. In this implementation, compressed air is utilized to perform both an out-stroke and an in-stroke. More particularly, in response to operation of the actuation control 18, e.g., transitioning the pneumatic switch to an "On" state, compressed air from the power source 38 flows through the actuation control 18 and through the first supply line 34 to the first supply port 26. In this regard, high air pressure is provided on a first side of the piston within the cylinder housing 24. Further, air on a second side opposite of the first side of the piston escapes from the cylinder housing 24, e.g., through the second supply port 28 and the second supply line 36 to an exhaust in the actuation control 18. Thus, the piston is transitioned linearly within the cylinder housing 24 towards the second end 24B, performing an out-stroke by extending the cylinder rod 30 out of the cylinder housing 24.

To perform an in-stroke, compressed air from the power source 38 flows through the actuation control 18 and through the second supply line 36 to the second supply port 28. In this regard, high air pressure is provided on the second side of the piston within the cylinder housing 24. Further, air on the first side of the piston escapes from the cylinder housing 24, e.g., through the first supply port 26 and the first supply line 34 to an exhaust in the actuation control 18. Thus, the piston is transitioned linearly within the cylinder housing 24 towards the first end 24A, performing an in-stroke by retracting the cylinder rod 30 into the cylinder housing 24. As noted above, in an illustrative implementation, the exhaust for both the out-stroke and the in-stroke is located in the actuation control 18. However, in practice, other exhaust schemes may be implemented.

As an alternative exemplary implementation, according to aspects of the present invention, the cylinder 14 may be implemented as a single-acting cylinder. In this regard, the first supply port 26 defines a compressed air port, and is the only port necessary for entry of compressed air into the cylinder 14. When the actuation control 18 is activated, compressed air from the power supply 38 flows through the third supply line 40 to the actuation control 18, and from the actuation control 18 through the first supply line 34 to the first supply port 26. In this regard, air pressure is provided on a first side of the piston within the cylinder housing 24. However, in this illustrative example, the second supply port 28 defines an exhaust port that allows air to escape the cylinder housing 24, e.g., though a muffler. Thus, by further allowing air pressure to release from the cylinder housing 24, e.g., through the second supply port, the piston is transitioned linearly within the cylinder housing 24 towards the second end 24B, thus performing an out-stroke by extending the cylinder rod 30 out of the cylinder housing 24.

In this implementation, there may be no need for the second supply line 36. However, the cylinder will not automatically retract the cylinder rod 30 in response to the switch transitioning to the Off state. As such, a user may be required to manually return the cylinder rod 30, or the cylinder rod 30 must be returned by another mechanism.

In yet a further illustrative example according to aspects of the present invention, the cylinder 14 may comprise a single-acting spring return cylinder. Much like the previous illustrative example, the first supply port 26 defines a compressed air port, and is the only port necessary for entry of compressed air. The out-stroke is thus analogous to that described above for the first single-acting cylinder example. Moreover, the second supply port 28 defines an exhaust port that allows air to escape the cylinder housing 24, e.g., through a muffler. However, in this illustrative example, the cylinder 24 includes a spring action in response to implementing an out-stroke and is thus capable of automatically retracting the cylinder rod 30 in response to the switch transitioning to the Off state. That is, when the switch transitions to the Off state, air is removed from the first supply port 26 allowing the spring action (within the cylinder) to push the cylinder rod 30 back into the cylinder housing 24, thus implementing an automatic in-stroke.

In this regard, a double-acting cylinder may be convenient, e.g., where it is desirable to utilize fluid pressure to both extend and retract the cylinder rod 30. However, depending upon the specific implementation, a double-acting cylinder may require relatively more air pressure for a given starting operation, compared to a single-acting cylinder. The single-acting cylinder may be used, for example, where conservation of air pressure is required, such as where the power source 38 is implemented as a tank with no corresponding compressor to automatically replenish the tank. The single-acting cylinder with spring provides a convenient way to automatically return the cylinder rod 30, but generally requires more air pressure to activate compared to a single-acting cylinder without spring return. Moreover, the cylinder 14 is not limited to exemplary configurations described above.

The illustrated exemplary implementation of the two-cycle engine starting device 10 is suitable for starting a tool such as a chainsaw. In this regard, the tool is started by securing the tool to the tool securement 22 and by slipping the starter rope handle of the tool into the handle holding mount 16. Depending upon the type of tool, the user may also be required to set a choke, prime the engine or perform other preliminary starting procedures associated with the tool. When the tool is ready to be pull started, the user operates the actuation control 18, e.g., the pneumatic switch. In response thereto, the cylinder rod 30 extends from the cylinder housing 24 with sufficient force to pull start the corresponding two-cycle engine.

Figure 2:
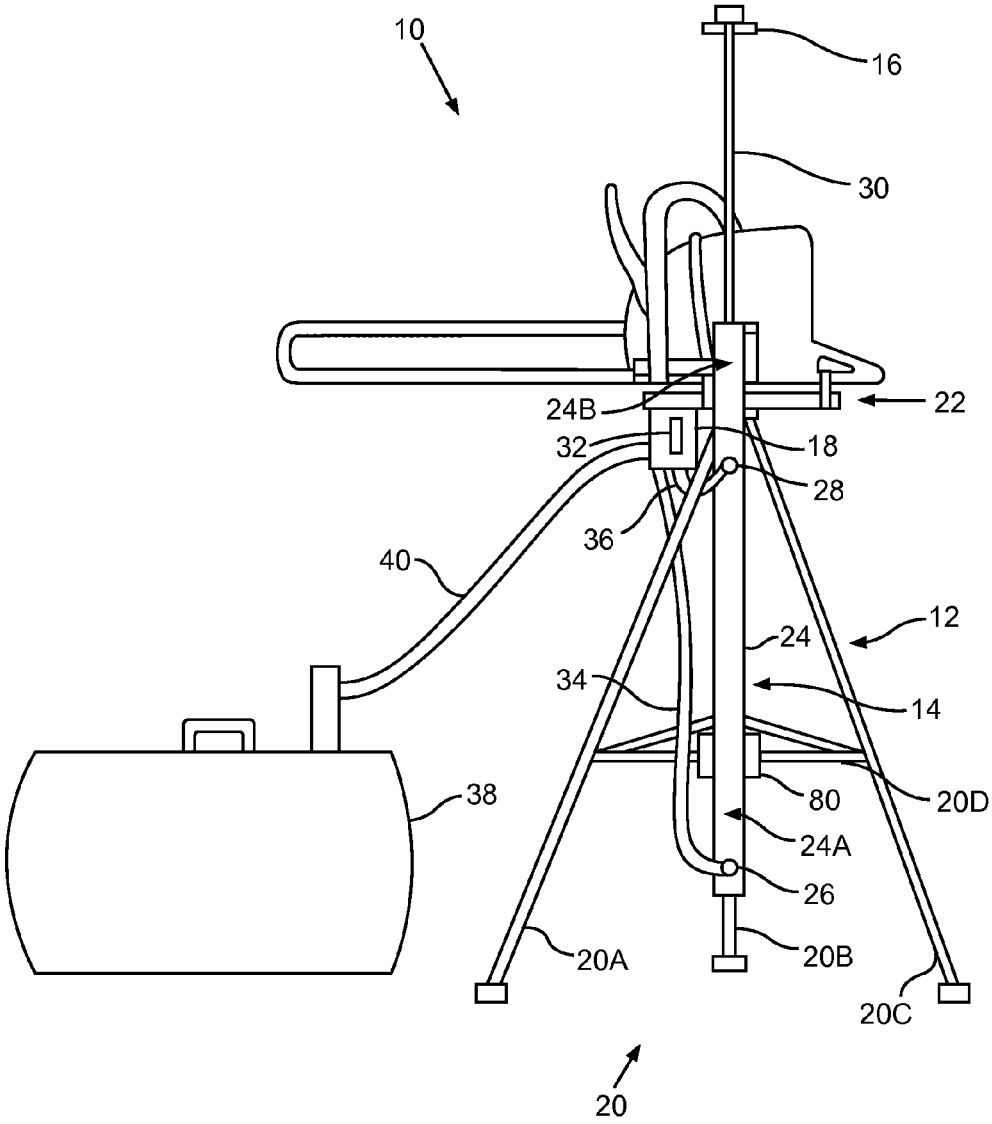
FIG. 2 is a view of the two-cycle engine starting device of FIG. 1, wherein the cylinder rod is extended, according to various aspects of the present invention.

Referring to FIG. 2, in response to operation of the actuation control 18, the cylinder 14 performs an out-stroke wherein the cylinder 14 is caused to extend the cylinder rod 30, e.g., by providing air pressure from the power source 38 to the cylinder 14 through the first supply port 26. Because the handle holding mount 16 is attached to the cylinder rod, the handle holding mount 16 is extended in a linear motion that pulls the starter rope with sufficient force to apply a starting force to start the two-cycle engine. After the cylinder rod 30 extends, an in-stroke is performed to retract the cylinder rod 30 back into the cylinder housing 24, as described more fully herein. In this regard, FIG. 1 illustrates the cylinder rod 30 retracted, and FIG. 2 illustrates the cylinder rod 30 extended. If the engine of the tool does not start, the actuation control 18 may be operated again to attempt to start the tool. Additionally, the user may be required to make adjustments, e.g., to the choke or other engine parameters to facilitate a successful start. If the tool starts, the user releases the tool from the locking arrangement(s) used to secure the tool during the starting operation and removes the tool from the tool securement 22. The user is now free to use the tool for its intended application.

As noted in greater detail herein, the power source 38 may comprise a tank of air. In this regard, the tank may or may not be coupled to a corresponding compressor. As an example, the tank may be free from connection to an air compressor, at least during use of the tank such that a limited number of starting operations may be performed before the tank needs to be replenished with compressed air. Thus, the tank may be filled with air, e.g., at a gas station or other location prior to use. The air tank may even be filled up using a manually operated air pump, such as a hand pump typically used to fill bicycle tires. The use of a manually operated air pump allows the tank to be replenished with compressed air, even when electricity or other automatic powered means of pumping air into the tank is unavailable. In this regard, the tank of air may provide only a limited number of starting actuations, e.g., depending upon factors such as the size of the tank, the amount of air required per actuation, etc. However, this approach provides a "self powered" solution that is portable and is not dependent upon external sources such as electricity to power a corresponding compressor. This makes utilization of the device possible in remote locations where access to electricity is inconvenient or where electricity is otherwise inaccessible.

Alternatively, the tank of air may be coupled to a corresponding compressor, such as an electrically powered conventional air compressor. The utilization of a compressor in combination with the air tank provides the ability to recharge or otherwise replenish the supply of air to the tank, which may be convenient, for example, where frequent starting actuations are required. In further illustrative examples, the power source 38 may comprise other sources, e.g., depending upon requirements of the cylinder 14.

In order to provide the correct amount of pull effort to start the engine of the tool mounted to the support structure 12, a user may be required to adjust the pressure of the power source 38. One exemplary approach is to use a conventional pressure regulator in line between the power source 38 and the third supply line 40. A conventional regulator is typically provided or otherwise utilized with a conventional air compressor.

By way of illustration, a power source 38 capable of providing between approximately 80-125 pounds per square inch (psi) is likely to be suitable for a broad cross section of powered tools. If the tank of air is not coupled to a compressor or other source of automatic replenishment, the pressure in the tank will drop with each operation. As such, the number of actuations will be limited by the ability of the tank to maintain at least the minimum required pressure to pull start a given type of tool. Moreover, the travel of the cylinder rod 30 should be calibrated, adjusted or otherwise limited to correspond with the length of the pull rope of the class of devices anticipated for use with the two-cycle engine starting device 10. For instance, in an exemplary implementation suitable for use starting a chainsaw, a pneumatic cylinder is utilized, which has an extension of approximately 24 inches (61 centimeters).

Figure 3:
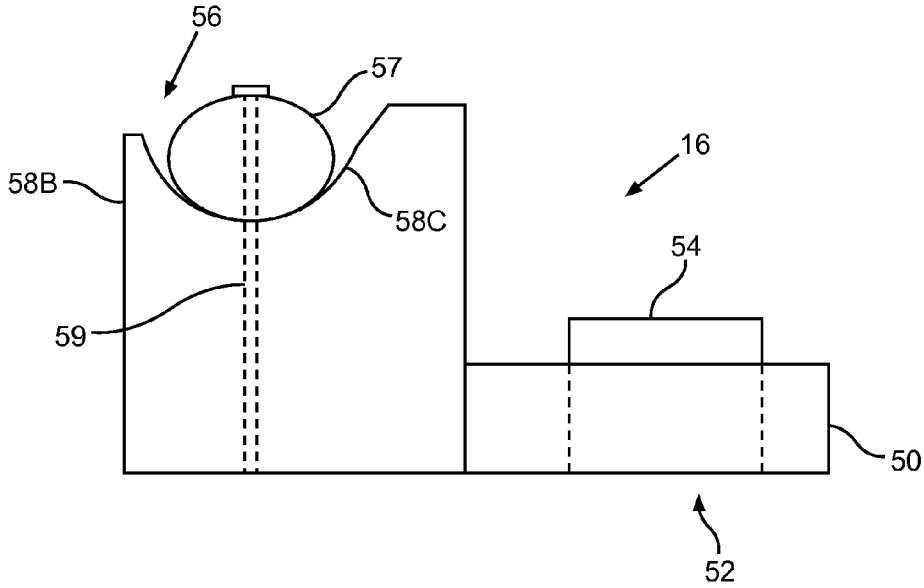
FIG. 3 is a side view of a handle holding mount that is secured to the end of the cylinder rod, according to various aspects of the present invention.
Figure 4:
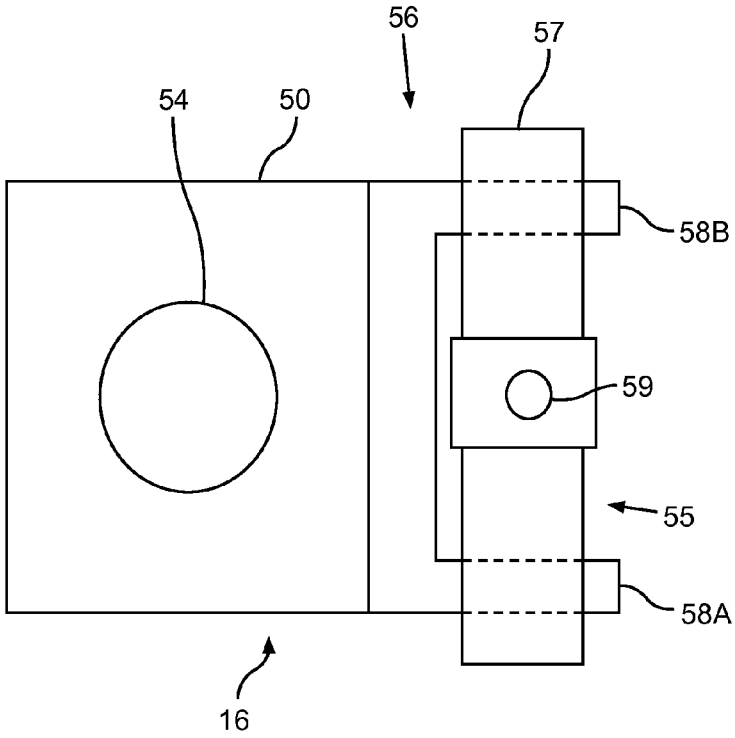
FIG. 4 is a top view of the handle holding mount of FIG. 3, according to various aspects of the present invention.

Referring to FIGS. 3 and 4, the handle holding mount 16 includes in general, a base section 50 having an aperture 52 there through. The aperture 52 is dimensioned such that the end of the cylinder rod 30 (FIG. 1) is firmly and securely coupled to the handle holding mount 16 at least during starting operations, for example, using any suitable securing arrangement 54. The handle holding mount 16 may further be able to swivel or otherwise be adjustable, e.g., rotatable. For instance, the end of the cylinder rod 30 (FIG. 1) may be threaded. The base section 50 is secured to the end of the cylinder rod 30 (FIG. 1) using a suitable locking washer and corresponding nut. In this manner, the base section 50 is securely held to the cylinder rod 30. However, the cylinder rod 30 is rotatable within the cylinder housing 24. As such, the handle holding mount 16 can be swiveled or otherwise rotated out of the way, so as to facilitate mounting a chainsaw or other suitable work tool on the holding plate of the tool securement 22. Once the tool is suitably mounted, the handle holding mount 16 can be rotated back into position. Other arrangements may alternatively be implemented. Still further, as noted above, the handle holding mount 16 may not require repositioning and may thus be fixedly attached to the end of the cylinder rod 30.

The handle holding mount 16 also includes a handle receiving section 56. The handle receiving section 56, as illustrated, includes a pair of handle arms 58A, 58B that extend out from the base section 50. Each handle arm 58A, 58B includes a concave slot 58C along its top surface. Moreover, a channel 55 is formed between the handle arms 58A, 58B. In use, a handle 57 attached to a pull rope 59 associated with a tool situated on the tool securement 22, is positioned so as to rest in the concave slot 58C of each handle arm 58A, 58B. In this regard, the middle section of the handle 57 is positioned generally within the channel 55 and the pull rope 59 extends through the channel 55 into the corresponding tool. For purposes of clarity of discussion herein, a handle 57 of a two-cylinder engine device is positioned within the channel 55 and rests on each handle arm 58A, 58B and is thus in a ready position for starting a corresponding device.

Figure 5:
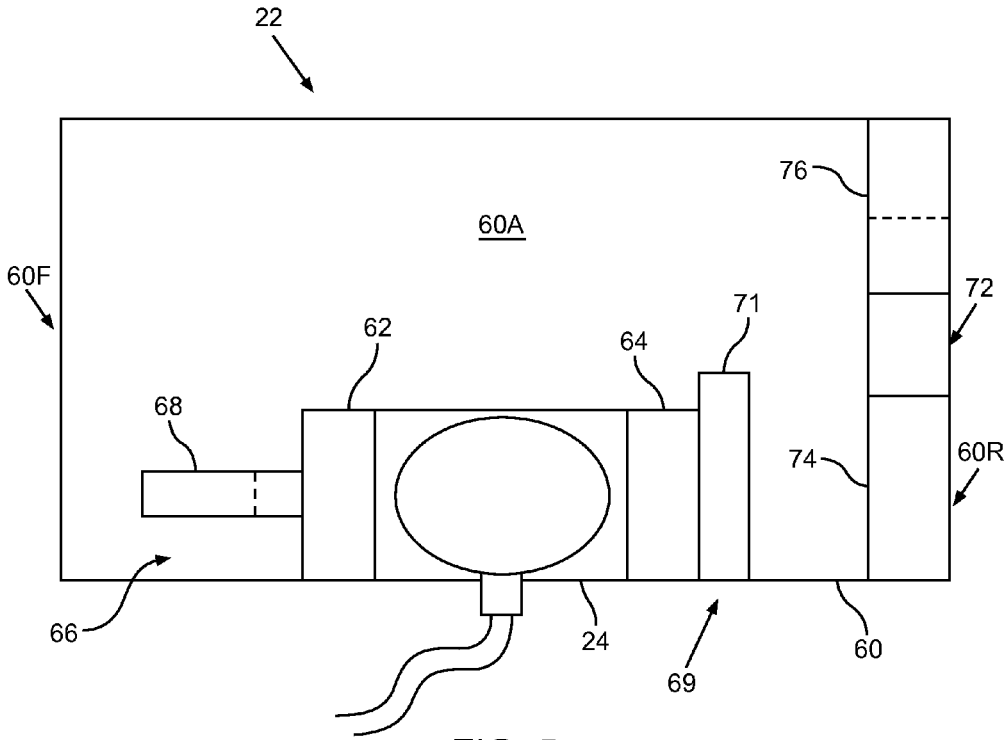
FIG. 5 is a top view of a tool securement, according to various aspects of the present invention.

Referring to FIG. 5, the tool securement 22 includes a holding plate 60 that serves as a base, platform or other suitable structure that supports the tool during starting operations. For instance, the holding plate 60 may be implemented using aluminum, plastic or other suitable material. Moreover, the holding plate 60 is suitable for use in starting a chainsaw in the illustrative example, and is thus dimensioned so as to provide a platform upon which the power unit of a chainsaw can rest. However, the holding plate 60 may need to be reconfigured, re-dimensioned, repositioned, etc., depending for example, upon the type or types of tools and/or engines to be started using the starting device 10.

Additionally, the tool securement 22 includes a first fastening block 62 and a second fastening block 64 extending upward from the base. The first fastening block 62 and the second fastening block 64 flank respective sides of the cylinder housing 24. The first fastening block 62 and the second fastening block 64 further attach to the cylinder housing 24 so that the cylinder housing 24 is rigidly supported by the tool securement 22. For instance, the cylinder housing 24 may pass through a notch or cutout in the holding plate 60. Alternatively, the cylinder housing 24 may run along the side of the holding plate 60. Regardless, the cylinder rod 30 extends and retracts in a direction substantially perpendicular to a major surface 60A of the holding plate 60 in this illustrative example. However, the direction of the cylinder rod 30 may be made adjustable to extend and retract in a different direction to correspond with the direction required to pull the starter rope of a corresponding engine.

The tool securement 22 also includes one or more tool locking arrangements 66, 69, 72 that temporarily hold, e.g., secure, fasten, lock, restrain or otherwise immobilize the engine with respect to the holding plate 60 in such a way that movement thereof is eliminated or at least substantially minimized to a degree sufficient to implement starting operations described more fully herein. For example, at least one locking arrangement 66, 69, 72 may be implemented as a "hold down" that temporarily prevents a portion, such as a handle or guard, of a tool temporarily secured to the holding plate from lifting when the actuation control is operated to pull the corresponding starter rope. As another example, the hold down may temporarily contact a portion of the tool to prevent lifting of the tool from the holding plate when the actuation control is operated to pull the corresponding starter rope.

Still further, the starting device 10 may comprise at least one arrangement that temporarily operates a control mechanism of a tool that is temporarily secured to the holding plate 60 that is required for starting operations of the tool. For instance, a hold down or other feature may temporarily hold a throttle, safety/kill switch or other device of a tool that requires actuation or operation in order to start the engine.

Figure 6:
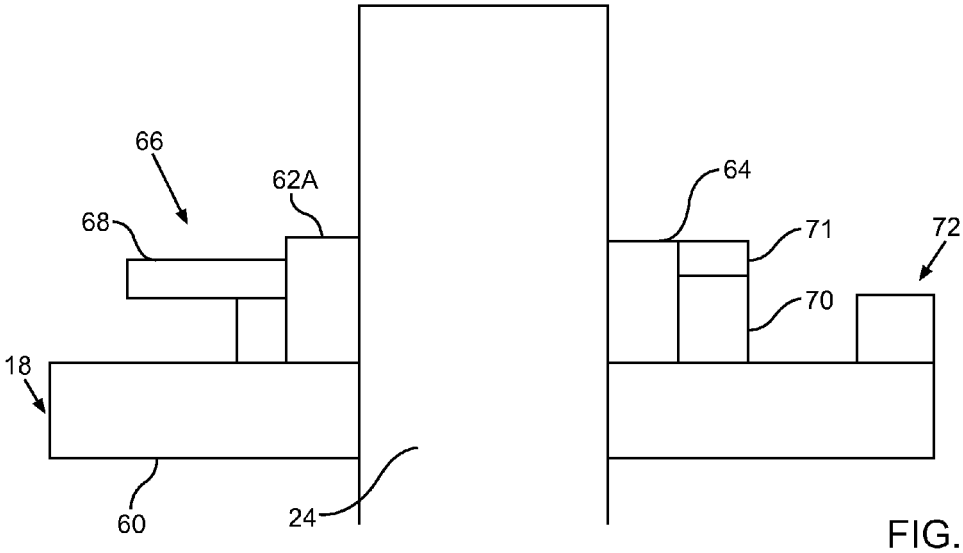
FIG. 6 is a side view of the tool securement of FIG. 5, according to various aspects of the present invention.

Referring to FIGS. 5 and 6, the holding plate 60 of the illustrated tool securement 22 includes in general, a front portion 60F and a rear portion 60R. A first locking arrangement 66 is provided towards the front portion 60F and along one side of the holding plate 60. The first locking arrangement 66 includes a locking arm 68 that is both located generally adjacent to and extends out from the first fastening block 62 to form a cantilevered member that is both generally parallel to and spaced from the surface of the holding plate 60. For instance, the locking arm 68 may be implemented as a Mylar arm having a shoulder portion that is secured to the holding plate 60 using appropriate fasteners, e.g., Allen bolts. Referring briefly to FIGS. 1, 2, 5 and 6, when a chainsaw 23 is positioned on the tool securement 22, the chainsaw 23 is initially positioned forward towards the forward portion 60F of the holding plate 60. The chainsaw 23 is then slid back towards the rear portion 60R of the holding plate 60. As the chainsaw 23 is slid back, and the lower portion of a handle system of the chainsaw 23 slips underneath of the locking arm 68. As such, upward lifting of the chainsaw 23 is prevented by the locking arm because a portion of the handle is temporarily trapped between the locking arm 68 and the holding plate 60. As such, the first locking arrangement 66 functions as a first hold down.

Figure 7:
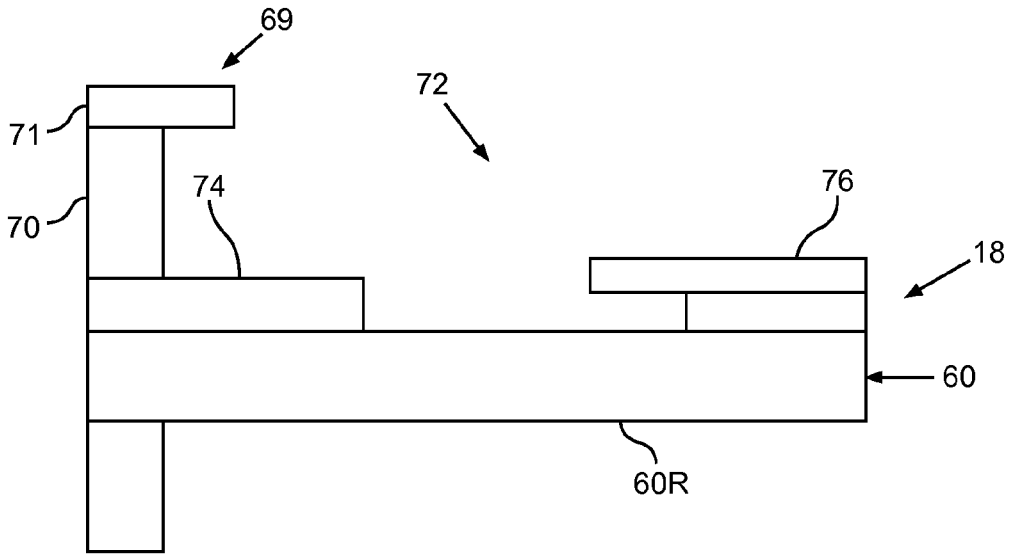
FIG. 7 is an end view of the tool securement of FIG. 5, according to various aspects of the present invention.

Referring to FIGS. 5, 6 and 7, a second locking arrangement 69 is implemented in an illustrative example, by a first block section 70 and a second block section 71. The second block section 71, e.g., a Mylar arm, is secured to the top of the first block section 70, e.g., an aluminum block section. As best illustrated in FIG. 7, the second block section 71 extends past the periphery of the first block section 70 so as to extend out over and across the holding plate 60. In the illustrative example, this defines a cantilevered arm that extends out over the holding plate 60, e.g., generally perpendicular to the cantilevered arm defined by the locking arm 68. When the chainsaw is installed on the holding plate 60, the second block section 71 serves as a second hold down to prevent up lifting of the chainsaw during starter rope pulls.

Referring to FIGS. 5 and 7, a third locking arrangement 72 may also be provided. In the illustrative example, the third locking arrangement 72 defines a throttle guard lock and includes a first handle support bar 74 and a second handle support bar 76, each positioned towards the rear portion 60B of the holding plate 60. The first handle support bar 74 is further spaced from the second handle support bar 76 so as to define a channel between the two support bars 74, 76. Moreover, the second handle support bar 76 has a cantilevered member extending towards the channel. As an illustrative example, the second handle support bar 76 may be implemented as a Mylar arm having a shoulder portion that is secured to the holding plate 60 using appropriate fasteners, e.g., Allen bolts, in a manner analogous to the locking arm 68 of the first locking arrangement 66.

Referring briefly to FIGS. 1, 2, 5 and 7, when the chainsaw is positioned on the tool securement 22, the rearward handle/throttle interlock of the chainsaw sits in the channel between the first handle support bar 74 and the second handle support bar 76. Once the chainsaw has been suitably positioned, the handle/throttle is slid under the cantilevered member, e.g., implemented as an extending arm of the second support bar 76, so as to retain the throttle interlock from moving up-and-down, thus serving as a third hold down.

As such, several separate and distinct locking features are provided by the tool securement 22 in the illustrative implementation. However, the particular locking features and corresponding tool securement described in the figures herein is presented by way of illustration, and not by way of limitation. Other structures and arrangements may be implemented, e.g., depending upon the specific two-cycle engine device and/or model of tool that the device 10 is intended to start. As such, other locking arrangements and securement arrangements are within the spirit of various aspects of the present invention. For instance, instead of the three locking arrangements 66, 69, 72, just one or any combination thereof may be utilized. Further, one or more different locking arrangements may be utilized as required by a particular tool or two-cycle engine.

In the illustrative implementation, the cylinder 14 is supported by the support structure 12 at the second end 24B of the cylinder housing 24 by the tool securement 22, first fastening block 62 and the second fastening block 64. However, it may be necessary or desirable at times to further support the cylinder 14 in one or more additional locations, e.g., proximate to the first end 24A to be of the cylinder housing 24.

Figure 8:
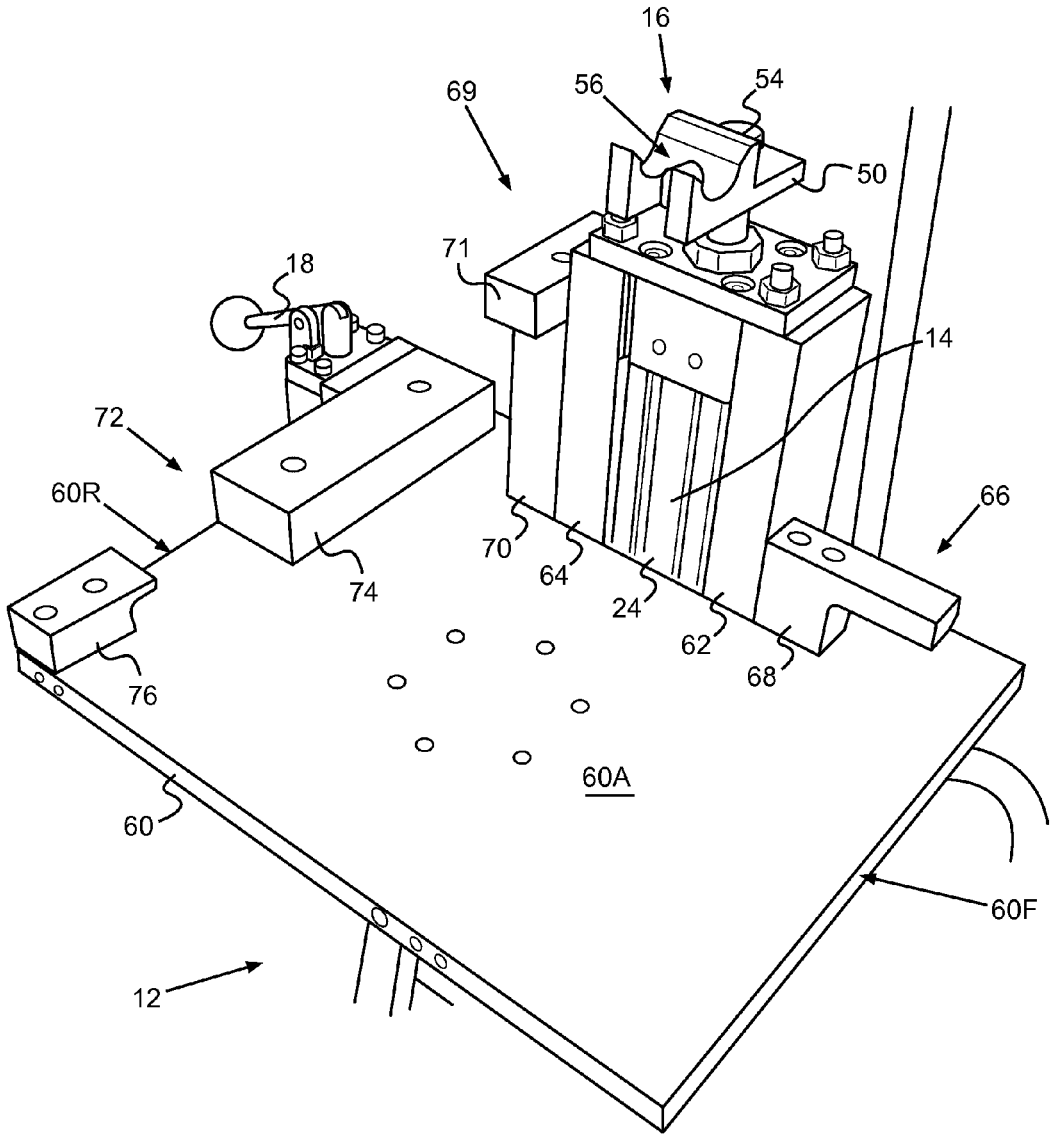
FIG. 8 is an isometric view of the tool securement of FIG. 5, according to various aspects of the present invention.

Referring to FIG. 8, an exemplary implementation of a two-cycle engine starting device 10 is illustrated, according to various aspects of the present invention. As with the previous exemplary implementations, the starting device 10 includes, in general, a support structure 12, a cylinder 14, a handle holding mount 16 and an actuation control 18. The support structure 12 includes a tripod and a tool securement including a holding plate 60 that serves as a base or platform that supports the tool during starting operations. This exemplary implementation locates the actuation control 18 towards a rear portion 60R of the holding plate 60.

In a manner analogous to that described more fully herein, the holding plate 60 includes a first locking device 66 comprising a locking arm 68. The locking arm 68 includes an arm portion that is raised from the holding plate 60 by a corresponding shoulder portion, as described more fully herein.

When a tool, e.g., a chainsaw in the illustrative example, is installed on the holding plate 60, the tool is positioned forward of the first locking arrangement 66 and is slid backwards towards the rear portion 60R of the holding plate 60. In this regard, the arm of the locking arm 68 extends over a handle portion of the tool, providing a hold down that prevents lifting of the tool that would otherwise prevent, inhibit or otherwise significantly reduce the effectiveness of a starting operation.

The holding plate 60 also supports a second locking arrangement 69. As with the previous examples, the second locking arrangement 69 includes a first block section 70 and a second block section 71 that cantilevers out over the holding plate 60, e.g., generally perpendicular to the arm of the locking arm 68. When the chainsaw is installed on the holding plate 60, the tool is positioned forward of the first locking arrangement 66 and is slid backwards towards the rear portion 60R of the holding plate 60. In this regard, the second block section 71 extends over a portion of the engine of the tool installed on the holding plate, thus providing a hold down that prevents lifting of the tool that would otherwise prevent, inhibit or significantly reduce the effectiveness of a starting operation.

The holding plate 60 also supports a third locking arrangement 72. The third locking arrangement 72 defines a throttle guard lock, and includes a first handle support bar 74 and a second handle support bar 76, each positioned towards the rear portion 60B of the holding plate 60. The first handle support bar 74 is further spaced from the second handle support bar 76 so as to define and channel there between. Moreover, the second handle support bar 76 has a cantilevered member extending towards the channel between the first and second handle support bars 74, 76.

When the chainsaw is installed on the holding plate 60, the tool is positioned forward of the first locking arrangement 66 and is slid backwards towards the rear portion 60R of the holding plate 60, a handle portion of the chainsaw is slid under the cantilevered member of the second handle support bar 76. In this regard, the second handle support bar 76 extends over a portion of the rear handle of the chainsaw providing a hold down that prevents lifting of the tool that would otherwise prevent, inhibit or otherwise significantly reduce the effectiveness of a starting operation.

In practice, there may be a small clearance or "play" defining a gap between the first, second and/or third locking arrangements 66, 69, 72 and the corresponding tool mounted on the holding plate 60, e.g., depending upon the make and/or model of tool. Regardless, the tool is secured to the holding plate 60 sufficiently to implement a starting operation.

Figure 9:
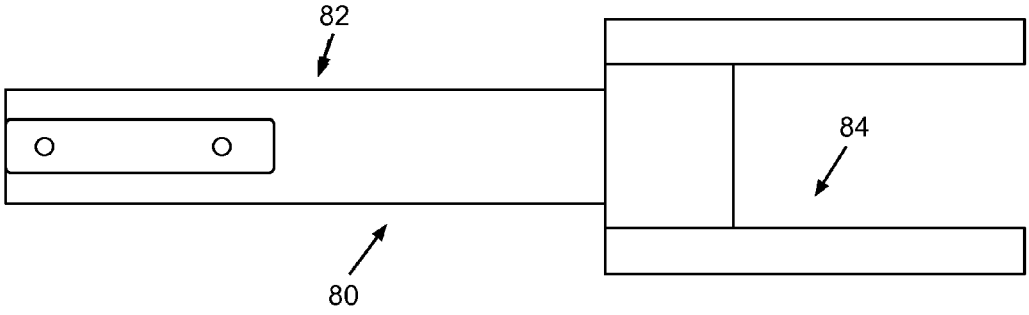
FIG. 9 is a view of a cylinder stabilizer for securing a lower portion of the cylinder, according to various aspects of the present invention.
Figure 10:
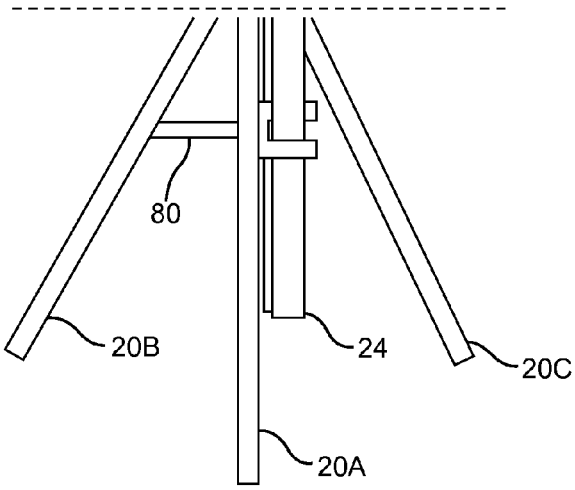
FIG. 10 is a view of select components of the cylinder and a support structure of FIG. 1, according to various aspects of the present invention.

Referring to FIG. 9, a cylinder stabilizer 80 may be utilized to further secure the cylinder 14. The illustrated cylinder stabilizer 80 includes a long extension portion 82 and a furcation portion 84. The furcation portion 84 is configured to hold the cross section of the cylinder housing 24. Referring back to FIG. 1 in conjunction with FIG. 10, the cylinder stabilizer 80 may be located towards the bottom end of the tripod. For instance, the extension portion 82 may couple to one or more of the tripod legs, e.g., 20B as illustrated. In this regard, the extension portion 82 extends generally horizontally out such that the furcation portion 84 grasps contacts, supports or otherwise secures the cylinder housing 24.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. For instance, the support structure 12, including the configuration of the base 20 and tool securement 22 can take other configurations, e.g., depending upon the specific type of two-cycle engine requiring starting assist. For instance, an outboard motor, leaf blower, string trimmer, or other two-cycle engine device each have unique physical attributes that affect the way that the device is put into a ready state for starting. Moreover, such tools each have different physical features, which may require specific hold downs and/or holding structures of the support structure 12. Moreover, the cylinder parameters including the cylinder stroke may need to be compensated for, e.g., depending upon the positioning of the engine relative to the cylinder 14, and/or based upon the length of the pull rope of the engine to be started. As such, specific structures may vary within the spirit and scope of various aspects of the present invention.

Having thus described the invention of the present application in detail and by reference to embodiments thereof, it will be apparent that modifications and variations are possible without departing from the scope of the invention defined in the appended claims.

What is claimed is:

1. A two-cycle engine starting device, comprising:

a support structure having a tool securement, the tool securement having a holding plate and at least one locking arrangement that temporarily holds a two-cycle engine equipped tool to the holding plate;

a cylinder secured to the support structure, the cylinder having a cylinder housing and a cylinder rod controllable to extend from the cylinder housing in a linear motion;

a handle holding mount coupled to an end of the cylinder rod that holds a handle attached to a starter rope of the two-cycle engine when the two-cycle engine is positioned on the holding plate; and an actuation control having a control element that is operable to cause the cylinder rod to extend from the cylinder housing.

2. The two-cycle engine starting device according to claim 1, wherein the support structure further comprises a tripod stand.

3. The two-cycle engine starting device according to claim 2, wherein:

the tripod stand further comprises a cylinder stabilizer that secures a lower portion of the cylinder housing to the support structure; and the tool securement secures an upper portion of the cylinder housing to the support structure.

4. The two-cycle engine starting device according to claim 1, wherein the cylinder comprises a pneumatic cylinder.

5. The two-cycle engine starting device according to claim 4, wherein the pneumatic cylinder further comprises a first port and a second port, at least one of the first port and second port is connected to the actuation control through a corresponding supply line.

6. The two-cycle engine starting device according to claim 1, wherein the holding plate is configured to support a chainsaw.

7. The two-cycle engine starting device according to claim 6 further comprising a first locking arrangement configured such that when a chainsaw is installed on the holding plate, the first locking arrangement temporarily holds the chainsaw to the holding plate by preventing a handle of the chainsaw from lifting up.

8. The two-cycle engine starting device according to claim 6 further comprising a cantilevered arm defined by a first block section attached to the holding plate and a second block section that extends from the top of the first block section generally out over the holding plate such that when a chainsaw is installed on the holding plate, the second block section serves as a hold down to prevent up lifting of the chainsaw during starter rope pulls.

9. The two-cycle engine starting device according to claim 6 further comprising a throttle guard lock attached to the holding plate that, when a chainsaw is installed on the holding plate, temporarily retains a handle of the chainsaw from lifting during starting operations.

10. The two-cycle engine starting device according to claim 6 further comprising:

a first locking arrangement having a locking arm extending above the holding plate that temporarily holds the chainsaw to the holding plate by preventing a handle of the chainsaw from lifting up;

a second locking arrangement having a cantilevered arm generally perpendicular to the locking arm of the first locking arrangement; and a third locking arrangement having a throttle guard lock attached to the holding plate that temporarily retains a handle of a chainsaw on the holding plate from lifting during starting operations, the throttle guard lock having a first handle support bar and a second handle support bar that forms a channel there between, the second handle support bar having a cantilevered member extending towards the channel.

11. The two-cycle engine starting device according to claim 1 further comprising:

a power source comprising a tank of compressed air coupled to the actuation control, wherein the actuation control is operable to allow the tank of compressed air to cause the cylinder rod to extend from the cylinder housing with sufficient force to pull a starter rope of a corresponding two-cycle engine equipped tool on the holding plate.

12. The two-cycle engine starting device according to claim 11, wherein the tank is independent from a connection to an air compressor during use such that a limited number of starting operations may be performed before the tank needs to be replenished with compressed air.

13. The two-cycle engine starting device according to claim 1, wherein the handle holding mount comprises a contour configured to receive a handle attached to a pull rope of a corresponding two-cycle engine equipped tool positioned on the holding plate.

14. The two-cycle engine starting device according to claim 1 further comprising at least one locking arrangement comprising a hold down that temporarily prevents a portion of a two-cycle engine equipped tool temporarily secured to the holding plate from lifting when the actuation control is operated to pull a starter rope of the two-cycle engine equipped tool.

15. The two-cycle engine starting device according to claim 14, wherein the hold down temporarily holds at least one of: a handle and a guard, of the two-cycle engine equipped tool temporarily secured to the holding plate from lifting when the actuation control is operated to pull the starter rope of the two-cycle engine equipped tool.

16. The two-cycle engine starting device according to claim 14, wherein the hold down temporarily contacts a portion of the two-cycle engine equipped tool to prevent lifting of the two-cycle engine equipped tool from the holding plate when the actuation control is operated to pull the starter rope of the two-cycle engine equipped tool.

17. The two-cycle engine starting device according to claim 1 further comprising at least one arrangement that temporarily operates a control mechanism of the two-cycle engine equipped tool that is temporarily secured to the holding plate, wherein the control mechanism is required for starting operations of the two-cycle engine equipped tool.

18. A two-cycle engine starting device, comprising:

a support structure having:

a holding plate configured to hold a chainsaw;

a first locking arrangement that, when a chainsaw is installed on the holding plate, temporarily holds the chainsaw to the holding plate by preventing a handle of the chainsaw from lifting up;

a second locking arrangement including a cantilevered arm comprising a first block section attached to the holding plate and a second block section that extends from the top of the first block section generally out over the holding plate such that when a chainsaw is installed on the holding plate, the second block section serves as a hold down to prevent up lifting of the chainsaw during starter rope pulls;

a third locking arrangement defined by a throttle guard lock attached to the holding plate that, when a chainsaw is installed on the holding plate, temporarily retains a handle of a chainsaw on the holding plate from lifting during starting operations;

a cylinder secured to the support structure, the cylinder having a cylinder housing and a cylinder rod controllable to extend from the cylinder housing in a linear motion;

a handle holding mount coupled to an end of the cylinder rod;

an actuation control having a control element that is operable to cause the cylinder rod to extend from the cylinder housing;

wherein a two-cycle engine is started by positioning a corresponding tool on the holding plate so as to be temporarily held at least by the first, second and third locking arrangements, slipping the starter rope handle into the handle holding mount, and operating the actuation control, thus causing the cylinder to extend the cylinder rod and corresponding handle holding mount in a linear motion that pulls the starter rope with sufficient force to apply a starting force to the two-cycle engine.

19. A method for starting a two-cycle engine including a starter rope with a handle, the method comprising:

positioning a tool with the two-cycle engine to be started on a holding plate so as to be temporarily held by at least one locking arrangement on the holding plate, slipping the handle of the starter rope into a handle holding mount coupled to a cylinder rod, and operating an actuation control coupled to a pressurized air source, which causes pressurized air to extend the cylinder rod and to move the handle holding mount in a linear motion that pulls the starter rope with sufficient force to apply a starting force to the two-cycle engine.

20. The method of claim 19, wherein:

positioning a tool further includes positioning a chainsaw including a handle, a throttle guard, and a two-cycle engine on the holding plate such that:

the chainsaw is positioned on the holding plate and is pulled backwards until a portion of the chainsaw handle is slid underneath a locking arm of a first locking arrangement;

a cantilevered arm of a second locking arrangement serves as a hold down to prevent up lifting of the chainsaw during starter rope pulls, wherein the cantilevered arm is generally perpendicular to the locking arm of the first locking arrangement; and the throttle guard of the chainsaw is positioned between a channel created by a first handle support bar and a second handle support bar of a throttle lock guard and the throttle lock of the chainsaw is slid under a cantilevered member of the second handle support bar so as to lock the throttle guard of the chainsaw within the channel.

* * * * *